United States Patent [19]

Wochnowski

[11] Patent Number: 4,934,385

[45] Date of Patent: Jun. 19, 1990

[54] METHOD OF AND APPARATUS FOR TREATING UNCURED TOBACCO

[75] Inventor: Waldemar Wochnowski, Hamburg, Fed. Rep. of Germany

[73] Assignee: Körber AG, Hamburg, Fed. Rep. of Germany

[21] Appl. No.: 216,320

[22] Filed: Jul. 7, 1988

[30] Foreign Application Priority Data

Jul. 11, 1987 [DE] Fed. Rep. of Germany ..... 3723080

[51] Int. Cl.[5] ..... A24B 3/18

[52] U.S. Cl. ..... 131/290; 131/299; 131/311

[58] Field of Search ..... 131/290, 299, 300, 303, 131/311, 313, 317, 318, 319, 320, 322, 324, 327

[56] References Cited

U.S. PATENT DOCUMENTS

| | | | |
|---|---|---|---|
| 3,404 | 1/1844 | Smith | 131/324 |
| 3,401,701 | 9/1968 | Pietrucci | 131/290 |
| 3,699,976 | 10/1972 | Abe et al. | 131/299 |
| 3,903,901 | 9/1975 | Wochnowski | 131/108 |
| 4,600,024 | 7/1986 | Edwards | 131/299 |
| 4,799,501 | 1/1989 | Liebbe et al. | 131/311 |

*Primary Examiner*—V. Millin

*Attorney, Agent, or Firm*—Peter K. Kontler

[57] ABSTRACT

Uncured tobacco leaves are heated by microwaves or in an electric high-frequency field prior to subdivision into ribs and strips. The strips are separated from the ribs, preferably with a stream of conditioned air, and are thereupon heated again and condensed, and the condensed strips are dried and cooled in vacuo prior to packing. The separated ribs are heated and are thereupon introduced into containers. The containers are then admitted into a vacuum chamber for cooling and drying of the ribs therein prior to packing.

52 Claims, 2 Drawing Sheets

METHOD OF AND APPARATUS FOR TREATING UNCURED TOBACCO

CROSS-REFERENCE TO RELATED CASE

The apparatus of the present invention is identical with the apparatus which is disclosed in the commonly owned copending patent application Ser. No. 07,216,424 filed July 7, 1988 for "Method of and Apparatus for Treating Uncured Tobacco" now U.S. Pat. No. 4,898,189.

BACKGROUND OF THE INVENTION

The invention relates to a method of and to an apparatus for treating uncured tobacco leaves (also called green tobacco). More particularly, the invention relates to improvements in methods of and in apparatus for treating uncured tobacco leaves for storage and/or shipment.

Harvested tobacco leaves are dried and normally fermented prior to shipment to processing plants. Such leaves have a moisture content of less than 25 percent, normally 12 to 17 percent and in most instances 14 to 16 percent. The leaves are often subjected to a compacting action to form bales or similar accumulations and the bales are delivered to processing plants which prepare them for extended storage and/or shipment—often overseas—to cigarette making factories or other types of factories which make smokers' products.

It is very important to ensure that the moisture content of uncured tobacco leaves match or closely approximate a value which is best suited for storage and shipment. The leaves or parts of leaves, such as ribs and tobacco leaf laminae (hereinafter called strips for short), are normally compacted preparatory to shipment and their moisture content should be in the range of 11 to 13 percent or very close to such value. Excessive moisture content is undesirable and damaging because the leaves and their parts then exhibit the tendency to mildew and they are likely to constitute a fertile ground for the growth of fungi. On the other hand, excessive drying of uncured tobacco leaves and/or their parts can lead to a reduction of quality because the leaves and their parts are brittle and tend to break during conversion into bales or the like.

The presently preferred methods of treating uncured tobacco leaves include subdivision of leaves into ribs and strips. The ribs are thereupon separated from strips and are treated separately. As a rule, such treatment involves introduction of ribs into suitable containers which are then prepared for storage or shipment. The separated strips are condensed or compacted to form bales or similar accumulations (hereinafter called bales for short) which are introduced into packing machines and are made ready for storage and/or shipment.

Condensing of strips or whole uncured leaves normally takes place at room temperature and at a moisture content of 10–11 percent which is the desired moisture content for storage and shipment. Such moisture content is too low for condensing into bales because a large percentage of leaves and strips breaks and suffers a pronounced loss of quality because the material which is converted into the fillers of cigarettes does not contain a high percentage of long shreds.

OBJECTS OF THE INVENTION

An object of the invention is to provide a novel and improved method of rapidly and gently processing uncured tobacco leaves for storage and/or shipment.

Another object of the invention is to provide a method which can be used for the treatment of entire tobacco leaves, for the treatment of separated ribs and/or for the treatment of separated strips.

A further object of the invention is to provide a method which is less expensive than heretofore known methods.

An additional object of the invention is to provide a method which involves automatic destruction of beetles which might be contained in or on the uncured tobacco leaves.

Still another object of the invention is to provide a method which can be practiced in such a way that the uncured tobacco leaves and/or the separated strips can be condensed into bales without risking any, or any appreciable, breakage and resultant reduction of the quality.

A further object of the invention is to provide a method which can be practiced in connection with the treatment of all kinds of uncured tobaccos.

Another object of the invention is to provide a method according to which uncured tobacco leaves can be processed with the expenditure of small quantities of energy.

An additional object of the invention is to provide a novel and improved apparatus for the practice of the above outlined method.

A further object of the invention is to provide the apparatus with novel and improved means for subjecting the uncured tobacco leaves and/or their parts to a plurality of treatments in a small area and with low expenditures of energy.

Another object of the invention is to provide a versatile apparatus which can be converted for treatment of uncured tobacco leaves or for treatment and subdivision of leaves and subsequent treatment of ribs and strips.

An additional object of the invention is to provide a tobacco processing plant which embodies the above outlined apparatus.

A further object of the inveneion is to provide the apparatus with novel and improved units for the treatment of uncured tobacco leaves and their parts.

Another object of the invention is to provide the apparatus with novel and improved means for enhancing the suppleness of uncured tobacco leaves and/or their parts prior to baling.

An additional object of the invention is to provide the apparatus with novel and improved means for ensuring that the final moisture content of uncured tobacco leaves and/or their parts will match or very closely approximate an optimum value.

SUMMARY OF THE INVENTION

One feature of the present invention resides in the provision of a method of treating uncured tobacco leaves which contain ribs and strips. The method comprises the steps of delivering at least the strips of the leaves to a condensing or compacting station, and converting the strips into a succession of bales. The method further comprises the step of maintaining the strips above room temperature in the course of the converting step, and the maintaining step preferably comprises heating the strips to a temperature of 50°–100° C., most preferably to a temperature of 70°-90° C. The heating preferably involves subjecting the strips to the action of microwaves or to the action of an electric highfrequency field.

The method preferably further comprises the step of drying and/or cooling the condensed strips (i.e., the bales) in vacuo.

As a rule, the moisture content of uncured tobacco leaves is between 10 and 18 percent, in most instances between 13 and 17 percent. The converting step can be preceded by the steps of subdividing such uncured tobacco leaves into ribs and strips, and separating the strips from ribs. The ribs are heavier than the strips and, therefore, the separating step can include subdividing the leaves in at least one stream of air or another gaseous carrier medium which is capable of entraining the strips but not the ribs. The subdividing step can be carried out in a plurality of successive stages in the at least one stream of gaseous carrier medium. The separating step of such method can include circulating the stream of gaseous carrier medium along an endless path, and the method can further comprise the step of conditioning (such as heating and/or changing, particularly increasing, the moisture content of) the carrier medium.

The uncured tobacco leaves can be heated to a temperature of 50°-100° C., preferably 60°-80° C., prior to the subdividing step, and such heating step can comprise subjecting the uncured leaves to the action of microwaves or to the action of an electric highfrequency field. The leaves can be conveyed past the heating station in the form of an at least substantially uniform flow.

The method can further comprise the steps of heating the separated ribs and drying and/or cooling the thus heated ribs in vacuo. The step of heating the separated ribs can include heating the ribs to a temperature of 50°-100° C., preferably 70°-90° C. Such heating can involve subjecting the separated ribs to the action of microwaves or to the action of an electric high-frequency field.

Another feature of the present invention resides in the provision of an apparatus for treating uncured tobacco leaves which contain ribs and strips. The apparatus comprises means for heating at least the strips of the tobacco leaves to a temperature of 50°-100° C., preferably 70°-90° C., means for condensing the heated strips, and means for delivering heated strips from the heating means to the condensing means. The heating means can comprise means for subjecting the strips to the action of microwaves or means for subjecting the strips to the action of an electric high-frequency field.

The apparatus can further comprise means for drying and/or cooling the condensed strips (such condensed strips can form bales) in vacuo.

Still further, the apparatus preferably comprises means for subdividing uncured tobacco leaves into ribs and strips prior to condensing of the strips. The ribs are heavier than the strips, and the apparatus preferably further comprises means for separating the strips from ribs. Such separating means preferably operates pneumatically and can include means for establishing and maintaining at least one stream of air or another gaseous carrier medium which is capable of entraining the separated strips but not the separated ribs. The subdividing means can be located in the at least one stream of gaseous carrier medium so that freshly subdivided leaves can be immediately classified according to their ribs and strips because the strips are entrained by the carrier medium while the ribs descend by gravity or are otherwise induced to leave the subdividing means. The latter can comprise at least one mobile subdividing element which is installed in the stream of the gaseous carrier medium. It is preferred to employ a subdividing means which comprises a plurality of subdividing elements which are disposed in the at least one stream and have means for relieving strips of ribs (and vice versa) with varying degrees of precision. The arrangement is preferably such that the subdividing elements are rotatable about substantially vertical axes, that they are disposed at different levels, and that each subdividing element which is designed to relieve strips with a higher degree of precision is located above at least one subdividing element which relieves the strips of ribs with a lesser degree of precision.

The separating means can include means for circulating the at least one stream of gaseous carrier medium along an endless path, and the apparatus can further comprise means for conditioning (such as heating, cooling, drying or increasing the moisture content of) the circulating carrier medium.

The apparatus can further comprise means for heating the uncured tobacco leaves to a temperature of 50°-100° C., preferably 60°-80° C., prior to subdivision of the leaves. Such means for heating the leaves can comprise means for subjecting the leaves to the action of microwaves or means for subjecting the leaves to the action of an electric high-frequency field. The just discussed heating means can further comprise means for conveying the uncured tobacco leaves in the form of an at least substantially uniform stream which is caused to advance through a heating zone wherein the leaves are acted upon by microwaves of by an electric high-frequency field.

The ribs which are separated from the strips can be treated in vacuo. Such treatment in vacuo can be preceded by a heating step which is carried out by a heating means operating with microwaves or with an electric high-frequency field and wherein the separated ribs can be heated to a temperature of 50°-100° C., preferably 70°-90° C.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Heretofore known apparatus for treating uncured tobacco leaves which are supplied by growers with a moisture content of 14 to 16 percent include means for increasing the moisture content of uncured leaves to 18-21 percent (often to as high as 26 percent) so as to enhance the suppleness of the leaves prior to subdivision into ribs and strips. Once the strips are separated from ribs, they are dried in large drying units which consume substantial amounts of energy and serve to reduce the moisture content of the strips to approximately 7 percent. Such drying is followed by cooling which, in turn, is followed by renewed moistening so that the strips have a moisture content of 10 to 13 percent which is considered to be the optimum moisture content for storage and shipment. Pronounced drying, cooling and renewed moisturizing are costly and time-consuming procedures which must be carried out by employing specially designed apparatus and necessitate the consumption of large quantities of energy; nevertheless, such procedure is accepted in order to ensure that the ultimate moisture content of separated strips will be within the optimum range for storage and shipment. When the strips exhibit the acceptable moisture content for storage and shipment (as mentioned above, such moisture content is normally between 10 and 13 percent), their temperature is only slightly above room temperature, and they are thereupon condensed and converted into bales. This entails pronounced breakage of relatively dry strips which affects the quality of the smokers' products, e.g., cigarettes, because the broken strips do not yield the desirable long shreds for the making of tobacco fillers.

Figure 1:
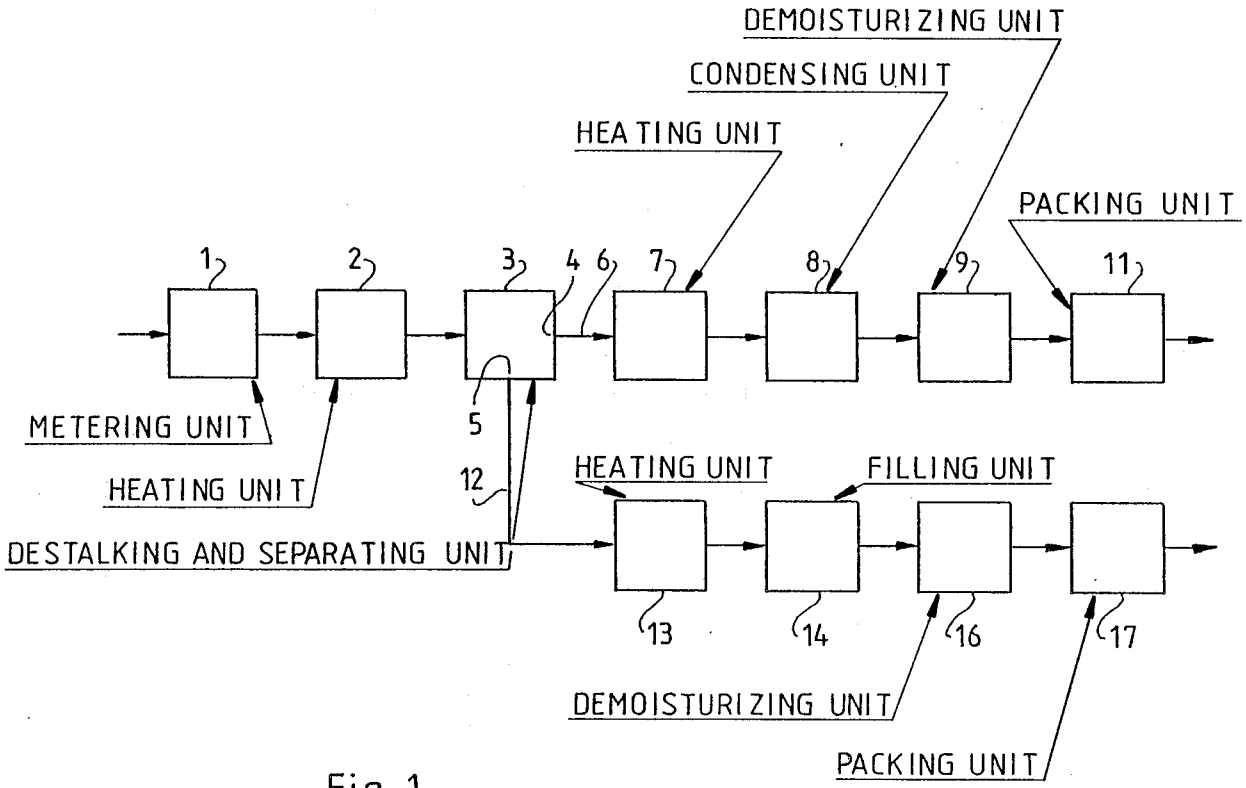
FIG. 1 is a block diagram of an apparatus which serves to treat uncured tobacco leaves and embodies the present invention.

The principle underlying the operation of the improved apparatus for treating uncured tobacco leaves departs from the aforediscussed principle underlying the operation of conventional apparatus. Referring first to FIG. 1, there is shown a metering unit 1 which receives accumulations (normally bales) of uncured tobacco leaves having a moisture content of 13 to 17 percent, normally 14 to 16 percent. The bales are delivered by growers of tobacco or by other suppliers, and the metering unit 1 comprises means for converting the accumulations into a continuous and at least nearly uniform flow or stream of uncured leaves. A suitable metering unit is disclosed in considerable detail in commonly owned U.S. Pat. No. 3,903,901 granted Sept. 9, 1975 to Wochnowski for "Method and Apparatus for Manipulating Tobacco". The disclosure of this patent, as well as of all other U.S. patents mentioned in the specification of the present application, is incorporated herein by reference.

Successive increments of the stream of uncured tobacco leaves which is formed in the metering unit 1 are caused to advance through a first heating unit 2 wherein the leaves are heated with electromagnetic waves, preferably by being exposed to the action of microwaves or in a dielectric heater by being exposed to the action of an electric high-frequency field. A heating unit which operates with microwaves is disclosed in U.S. Pat. No. 4,600,024 granted July 15, 1986 to Edwards for "Tobacco Separation Pretreatment System". Dielectric heating units which operate with electric high-frequency fields are disclosed, for example, in German Pats. Nos. 934,488 and 896,242 as well as in numerous patents.

The heating unit is designed to raise the temperature of uncured tobacco leaves to a temperature of 50°–100° C., preferably 60°–80° C. Such heating does not involve any, or involves only minimal, changes of moisture content of the leaves. At any rate, the moisture content is not increased to 18–21 percent (or even to 26 percent) as in accordance with presently prevailing methods of treating uncured tobacco leaves prior to subdivision into ribs and strips.

Successive increments of the stream of heated leaves are then delivered into a subdividing or destalking unit 3 wherein the strips are separated from ribs, preferably in a series of successive stages. A suitable subdividing or destalking unit is disclosed in U.S. Pat. No. 3,401,701 granted Sept. 17, 1968 to Pietrucci for "Process and Means for Separating the Parenchyma from Lignacious Parts of Vegetable Leaves and in Particular Tobacco". A similar destalking unit is distributed by the assignee of the present application and is known as VT. It comprises means for mechanically detaching the strips from ribs in a plurality of successive stages with varying degrees of preciseness and in at least one stream of air or another suitable gaseous carrier medium so that the carrier medium can entrain the relatively lightweight strips but not the heavier ribs. As will be explained in greater detail with reference to FIG. 2, the detaching means of the subdividing unit 3 comprises a plurality of mobile detaching elements which are disposed one above the other and are rotatable about substantially vertical axes. Each stage wherein the strips are detached with a lesser degree of preciseness is disposed above at least one stage wherein the strips are separated from ribs with a higher degree of precision. The rotary detaching elements are rotatable in fixedly mounted basket-like elements having bars which cooperate with teeth or other suitable projections of the rotary detaching elements to rip the strips from ribs at a plurality of different levels.

The subdivision of heated uncured tobacco leaves into strips and ribs takes place simultaneously with a classifying operation which involves separation of strips from the ribs so that the strips can leave the subdividing unit 3 by way of a first outlet 4 whereas the ribs leave the unit 3 by way of a second outlet 5. The separating means includes means for establishing and maintaining one or more streams of gaseous carrier medium, and the rotary and stationary detaching elements of the subdividing unit 3 are installed in such stream or streams which are caused to entrain the separated strips upwardly and into the inlet 4 while the separated ribs descend by gravity and leave the unit 3 via outlet 5. The stream or streams of the gaseous carrier medium are preferably conditioned in such a way that a thermal or hygroscopic equilibrium is established between the carrier medium (normally air) and the separated particles of the tobacco leaves. In other words, the stream or streams of ascending carrier medium do not influence the condition of the separated ribs and/or strips, and such strips and/or ribs do not influence the condition of the carrier medium.

As mentioned above, it is not necessary to raise the moisture content of uncured leaves prior to the subdividing step, especially of the initial moisture content of the leaves is at least close to 14–16 percent at the outlet of the heating unit 2. Cooling of tobacco leaves on their way from the heating unit 2 toward the subdividing unit 3 is or can be compensated for, at least in part, by the circulating gaseous carrier medium which lifts the separated strips and carries them toward and beyond the outlet 4 so that the strips reach a conveyor 6 which advances them toward and into a second heating unit 7. For example, the temperature of strips which leave the subdividing unit 3 by way of the outlet 4 can approximate 50° C. Such strips are then heated in the unit 7 so that their temperature is between 50°–100° C., preferably between 70°–90° C. The heating unit 7 is or can be identical with or similar to the heating unit 2, i.e., the strips can be acted upon by microwaves or in an electric high-frequency field.

Heated tobacco strips which leave the unit 7 are delivered into a condensing or compacting unit 8 (e.g., a suitable press) wherein the strips are condensed to form a series of bales with a minimum of breakage of strips since the strips are supple and can readily flex in the course of the condensing separation. This is ensured by the second heating unit 7 which causes the strips to advance toward the condensing unit 8 at a temperature of preferably 70°-90° C. The temperature of strips which form the bales and leave the condensing unit 8 is normally close to 65° C., and their moisture content is approximately 13%, i.e., only slightly less than that of uncured leaves which are delivered to the metering unit 1. It is assumed here that no moisturizing of tobacco leaves and/or separated strips has taken place in or between the units 1, 2, 3, 7 and 8.

The bales which leave the condensing unit 7 are introduced into a demoisturizing or drying unit 9 having a vacuum chamber wherein the strips which form the bales are dried and cooled so that their moisture content is reduced to 10-11 percent which is considered to be an optimum moisture content for storage and/or shipment. The thus dried and cooled bales are then admitted into a packing unit 11 wherein they are made ready for storage and/or shipment in any conventional manner not forming part of the present invention.

It has been found that heating of tobacco leaves and strips by microwaves or in an electric high-frequency field, as well as the treatment of bales in the vacuum chamber of the demoisturizing unit 9, invariably ensures destruction of all kinds of vermin such as tobacco beetles, their larvae and eggs.

The units 2 and 3 or 3 and 7 are omitted if the apparatus of the present invention is used for baling and shipment of uncured tobacco leaves without subdivision into ribs and strips. In other words, it is then merely necessary to heat the uncured leaves once (in the unit 2 or 7) prior to admission of heated leaves into the condensing unit 8. Conversion of bales is followed by introduction into the demoisturizing unit 9 and thence into the packing unit 11.

The outlet 5 of the separating unit 3 admits the separated ribs into or onto a conveyor 12 which delivers a continuous stream of such ribs into a further heating unit 13. As a rule, or in most instances, the moisture content of ribs which leave the separating unit 3 at 5 equals or approximates 14 percent. Such ribs are likely to have been cooled on their way from the heating unit 2 toward and with the conveyor 12. The purpose of the heating unit 13 is to ensure that the temperature of ribs which are discharged thereby is within the range of 50°-100° C., preferably 70°-90° C. A presently preferred temperature of ribs which leave the heating unit 13 is approximately 80° C. The means for heating the separated ribs at 13 can be identical with the means employed in the heating unit 2 and/or 7, e.g., the ribs can be heated by being acted upon by microwaves or by an electric high-frequency field.

The ribs which leave the heating unit 14 are admitted into a filling unit 14 wherein they are introduced into containers, and the filled containers are thereupon delivered to a demoisturizing unit 16 having a vacuum chamber wherein the ribs in the containers are cooled and dried, preferably to a moisture content of 10-11 percent which is considered to be highly satisfactory for the purposes of storage and shipment. The containers are then introduced into a conventional packing unit 17 wherein they mare made ready for storage and shipment in any conventional manner not forming part of this invention.

It is possible to reverse the positions of the units 13 and 14, i.e., ribs which are delivered by the conveyor 12 can be admitted into containers in the unit 14, and the thus filled containers are thereupon caused to advance through the heating unit 13 prior to entering the demoisturizing unit 16.

Figure 2:
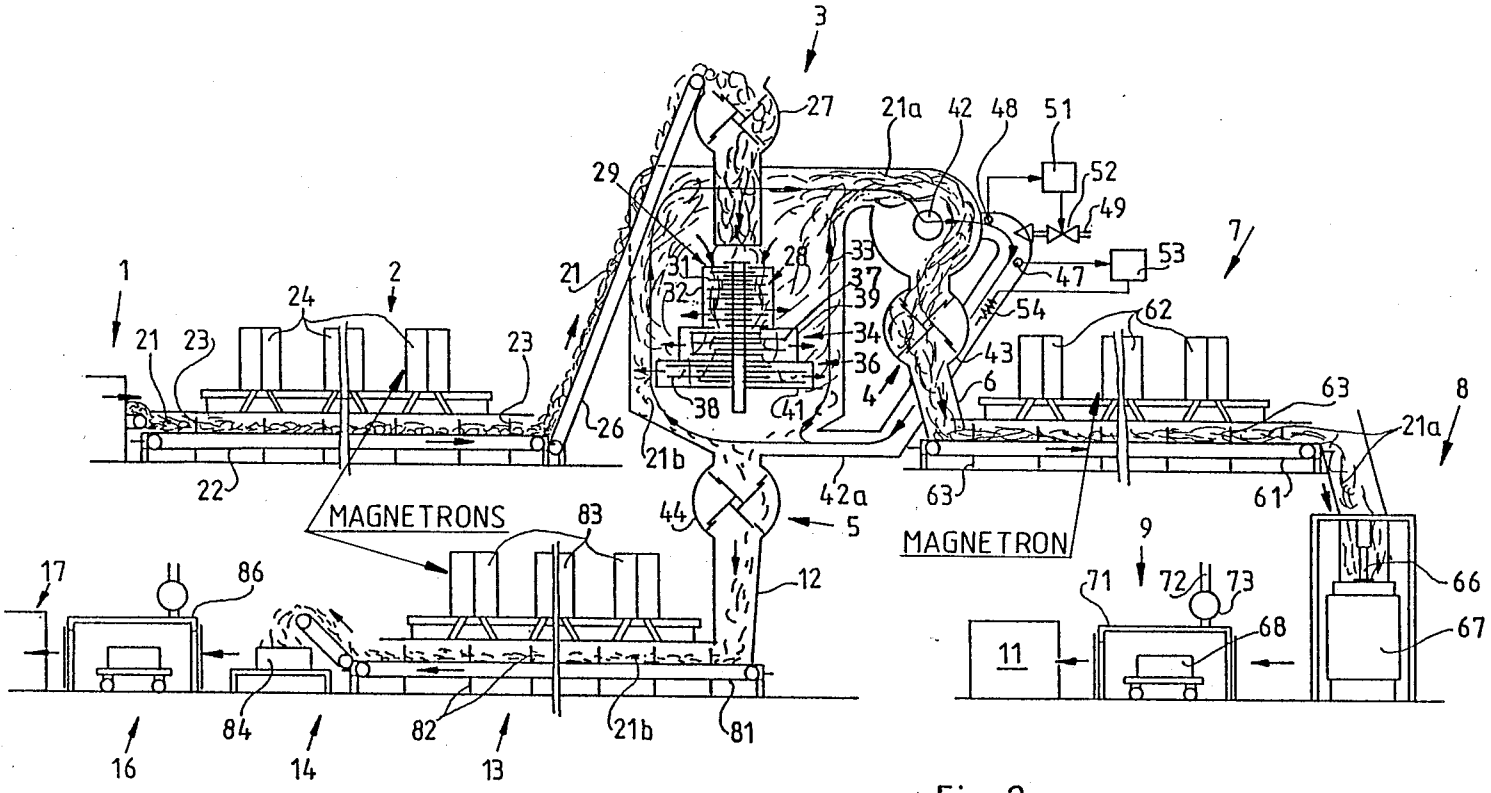
FIG. 2 is a schematic elevational view of certain units in the improved apparatus.

FIG. 2 shows all necessary details of the units 2, 3, 7, 8, 9, 13, 14 and 16. As mentioned above, the unit 1 can be identical with that which is disclosed in the aforementioned patent to Wochnowski, and the details of the packing units 11 and 17 form no part of the present invention.

The metering unit 1 discharges a continuous and preferably at least slightly uniform flow or stream of uncured tobacco leaves 21 to an endless belt conveyor 21 which forms part of or cooperates with the heating unit 2 and serves to advance successive increments of the stream or flow through a heating zone wherein the leaves are heated by microwaves issuing from suitable generators, such as magnetrons 24. Reference may be had to the aforementioned patent to Edwards. The moisture content of uncured leaves 21 on the conveyor 23 is between 13 and 17 percent, normally 14-16 percent. The conveyor 22 is provided with spaced-apart transversely extending partitions 23 which prevent escape of microwaves from the heating zone of the unit 2. The temperature of leaves 21 which are advanced beyond the heating unit 2 is 50°-100° C., preferably 60°-80° C. This enhances the suppleness of the leaves 21 so that they can be readily flexed without breaking on entry into the subdividing unit 3. The latter has an inlet formed by a gate 27 employing a rotary cell wheel and receiving heated tobacco leaves 21 from an elevator conveyor 26 which, in turn, receives leaves 21 from the discharge end of the belt conveyor 23. The gate 27 prevents escape of a conditioned gaseous carrier medium (normally air) which is used in the subdividing unit 3 to separate strips 21*a* from ribs 21*b*.

The leaves 21 which descend beyond the gate 27 enter the range of a first or uppermost detaching element 28 which is driven to rotate about a vertical axis and forms part of a threshing or destalking device 29. The projections or teeth 31 of the rotary detaching element 28 coperate with the vertical bars of the surrounding stationary detaching element 32 which resembles a basket and permits the freshly liberated strips 21*a* to pass radially outwardly into the stream or streams 33 of ascending gaseous carrier medium which flows toward and into the outlet 4 of the subdividing unit 3. The ribs 21*b*, as well as those portions of uncured leaves 21 which contain ribs and portions of strips 21*a*, are too heavy to rise with the stream or streams 33 so that they descend from the topmost stationary detaching element 32 into the stationary detaching element of the next (lower) destalking device 34. The latter also comprises a rotary detaching element which is or can be coaxial with the detaching element 28 of the topmost destalking device 29, and the device 34 is followed by a third or lowermost destalking device 36 whose mode of operation is or can be identical with that of the device 29 except that it ensures detachment of strips 21*a* from ribs with a degree of precision exceeding that in the device 34. The latter, in turn, can ensure detachment of strips 21*a* from ribs 21*b* with a degree of preciseness exceeding that in the topmost destalking device 29. The teeth of rotary detaching elements in the destalking devices 34 and 36 are respectively shown at 37 and 38, and these teeth cooperate with the vertical bars of the respective stationary detaching elements 39 and 41.

The bars of the stationary detaching element 39 are more distant from each other than those of the detaching element 41 but are nearer to each other than the bars of the topmost stationary detaching element 32. It will be seen that subdivision of leaves 21 into ribs **21*b* and strips 21*a* takes place in a series of successive stages while the ribs and those strips which continue to adhere to ribs descend whereas the separated strips move radially outwardly beyond the stationary detaching elements 32, 39, 41 to be immediately and directly entrained by the stream or streams 33 which deliver them into the outlet 4 of the subdividing unit 3**.

The gaseous carrier medium is separated from the strips **21*a* by flowing through a perforated pipe 42 which does not permit the strips 21*a* to pass through its perforations. The strips 21*a* enter a gate 43 at the outlet 4 and are admitted into the aforementioned conveyor 6 which is a tube serving to deliver the strips into the second heating unit 7. A third gate 44, also employing a rotary cell wheel, is used to evacuate the separated ribs 21*b* by way of the outlet 5 while preventing the escape of the gaseous carrier medium from the subdividing unit 3**.

The pipe 42 forms part of a means for circulating the gaseous carrier medium along an endless path. A portion of such path coincides with the path for transport of separated or liberated strips **21*a* from the region surrounding the destalking units 29, 34, 36 to the outlet 4, and the separating means further comprises a conduit 42*a* which receives gaseous carrier medium from the conduit 42 and readmits it into the housing of the subdividing unit 3. A conventional fan (not specifically shown) is provided to circulate the carrier medium along the endless path. A sensor 47 in the conduit 42*a* monitors the temperature of the circulating gaseous carrier medium, and the moisture content of such medium is monitored by a second sensor 48. Signals which are transmitted by the moisture detecting sensor 48 are amplified at 51 and are used to regulate a valve 52 in a conduit 49 which is connected to a source of water. Signals which are transmitted by the temperature detecting or monitoring sensor 47 are amplified at 53 and are transmitted to an electric resistance heater 54 in the conduit 42*a* so as to ensure that the temperature of the circulating gaseous carrier medium is maintained within an optimum range. The conduit 49 preferably admits atomized water which affects the moisture content of the circulating gaseous carrier medium to an extent determined by the momentary setting of the valve 52, i.e., by the intensity and/or other characteristics of the signals which are transmitted by the sensor 48**. The arrangement is preferably such that the moisture content of the circulating gaseous carrier medium is maintained at a constant value. The same preferably applies for the temperature of the carrier medium.

It is also possible to regulate the temperature and/or the moisture content of the circulating gaseous carrier medium in a different way, for example, by regulating the rate of admission of fresh atmospheric air into the pipe 42 and/or conduit **42*a*. All that counts is to ensure that the moisture content and temperature of the carrier medium are selected with a view to maintain the carrier medium and the fragments of tobacco leaves 21** in a state of thermal and hygroscopic equilibrium. Thus, and as already mentioned hereinabove, the state of equilibrium is reached if the carrier medium does not influence (or does not appreciably influence) the characteristics of tobacco particles and vice versa. It has been found that such state of equilibrium can be achieved if the temperature of the gaseous carrier medium is maintained between 50° and 90° C., preferably between 60° and 80° C., and if the relative moisture content of the carrier medium is between 50 and 70 percent.

The temperature of separated tobacco strips **21*a* drops somewhat not later than in the conveyor 6 and, therefore, the apparatus further comprises the aforementioned second heating unit 7. The temperature of strips 21*a* on their way toward the endless belt conveyor 61 of the heating unit 7 is normally close to 50° C. The unit 7 is or can be identical with the heating unit 2, i.e., it can comprise several magnetrons 62 or other suitable sources of microwaves, and the conveyor 61 can be provided with partitions 63 which prevent the microwaves from leaving the heating zone above the upper reach of the conveyor 61. The unit 7 raises the temperature of the strips 21*a*** to 50°–100° C., preferably 70°–80° C. A presently preferred temperature is approximately 80° C.

The thus heated strips **21*a* are caused to descend beyond the discharge end of the conveyor 61 and enter the vessel 67 of the condensing or compacting unit 8. The latter further comprises a reciprocable (preferably hydraulically operated) ram 66 which cooperates with the vessel 67 to convert the continuously supplied strips 21*a* into a succession of bales 68 or analogous accumulations of condensed or compacted strips. Condensation of strips 21*a* takes place while the temperature of the strips at least equals 50° C. so that the strips can be readily flexed with a minimum of breakage (if any). The relatively high moisture content of strips 21*a* in the vessel 67** also contributes to suppleness and reduces the likelihood of breakage.

Successive bales 68 containing tobacco strips **21*a* whose temperature is approximately 60° C. and whose moisture content (approximately 13 percent) is only slightly below the initial moisture content (of the leaves 21) are thereupon introduced into the vacuum chamber 68 of the demoisturizing unit 8. The latter comprise a pump 73 or other suitable means for evacuating air from the chamber 71 by way of a conduit 72. The bales 68 are cooled in vacuo and the moisture content of their strips 21*a* is reduced by 2–3 percent to the final moisture content of 10–11 percent which is considered to be an optimum value for storage and shipment. The thus treated bales 68 are thereupon delivered to the unit 11** which has means for packing the bales in a conventional manner.

The ribs **21*b* which leave the subdividing unit 3 by way of the gate 44 at the outlet 5 enter a tubular conveyor 12 which delivers them to the endless belt conveyor 81 of the third heating unit 13. The conveyor 81 has partitions 82 which prevent escape of microwaves from the heating zone above the upper reach of the conveyor 81. The source of microwaves can include a plurality of magnetrons 83. The purpose of the unit 13 is to restore, if necessary, the temperature of ribs 21*b* to 50°–100° C., preferably to 70°–90°, and most preferably to approximately 80° C. The thus heated ribs 21*b* are then admitted into the unit 14 wherein they enter successive containers 84, and the filled containers 84 enter the vacuum chamber 86 of the demoisturizing unit 16**.

The purpose of the chamber 86 is to effect a cooling of the ribs 21b and to reduce their moisture content to an optimum value for storage and shipment, e.g., between 10 and 11 percent. The containers 84 with the thus treated ribs 21b therein are then transferred into the packing unit 17 which prepares them for storage or shipment.

The unit 14 can precede the heating unit 13, i.e., the conveyor 12 can admit ribs 21b directly into successive containers 84 and successive filled containers are thereupon caused to advance through the heating zone of the unit 13 prior to reaching the vacuum chamber 86 of the demoisturizing unit 14.

An important advantage of the improved method and apparatus is that the treatment of uncured leaves 21 is less expensive than in accordance with heretofore known methods and in heretofore known apparatus because it is not necessary to increase the moisture content of the leaves 21 and/or their parts at any stage of the operation. Moreover, the leaves and their parts are treated gently so that the percentage of broken tobacco strips 21a is a small fraction of those which are treated in conventional apparatus. The energy requirements of the improved apparatus are much smaller than those of heretofore known apparatus, and the improved apparatus ensures automatic destruction of all parasites, their larvae and eggs in the course of processing of the leaves and their parts.

The absence of any steps of raising the moisture content of the leaves and/or their parts contributes to simplicity and compactness of the apparatus. All that is necessary is, if desired, to provide means (note the conduit 49 and valve 52) for maintaining the moisture content of the circulating gaseous carrier medium in the endless path including the pipe 42 and conduit 42a at a substantially constant value.

The vacuum chambers 71 and 86 exhibit the advantage that they ensure highly uniform cooling and drying of the tobacco parts (i.e., of the strips 21a in the bales 68 and of the ribs 21b in the containers 84) which are admitted into the respective demoisturizing units 9 and 16. This ensures that each and every layer of each bale 68 and each and every stratum of ribs 21b in each container 84 has an optimum moisture content for storage and shipment.

A further important advantage of the improved apparatus is its versatility. Thus, the apparatus can be used for the treatment of uncured leaves 21 which need not be subdivided into strips 21a and ribs 21b. However, if it is desired to store and/or ship the strips 21a independently of the ribs 21b, the apparatus can be used with equal advantage for such treatment of separated parts of the leaves 21. The apparatus can be assembled of several modules so that it can be converted for different types of operation with little loss in time. Moreover, the positions of certain units can be interchanged (e.g., the unit 14 can be placed ahead of the unit 13) without departing from the spirit of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of treating uncured tobacco leaves which contain ribs and strips, comprising the steps of subdividing the leaves into ribs and strips; delivering at least the strips of the leaves to a condensing station; converting the strips into a succession of bales including condensing the strips; separating the strips from ribs prior to said condensing step; and maintaining the strips above room temperature in the course of said converting step.

2. The method of claim 1, wherein said maintaining step comprises heating the strips to a temperature of 70°-90° C. prior to said converting step.

3. The method of claim 1, wherein said maintaining step comprises heating the strips to a temperature of 50°-100° prior to said converting step.

4. The method of claim 3, wherein said heating step comprises subjecting the strips to the action of microwaves.

5. The method of claim 3, wherein said heating step comprises subjecting the strips to the action of an electric high-frequency field.

6. Apparatus for treating uncured tobacco leaves which contain ribs and strips, comprising means for heating at least the strips of the tobacco leaves to a temperature of 70°-90° C.; means for condensing the heated strips; and means for delivering heated strips from said heating means to said condensing means.

7. Apparatus for treating uncured tobacco leaves which contain ribs and strips, comprising means for heating at least the strips of the tobacco leaves to a temperature of 50°-100° C.; means for condensing the heated strips; and means for delivering heated strips from said heating means to said condensing means.

8. The apparatus of claim 7, wherein said heating means comprises means for subjecting the strips to the action of microwaves.

9. The apparatus of claim 7, wherein said heating means comprises means for subjecting the strips to the action of an electric high-frequency field.

10. The apparatus of claim 7, further comprising means for drying the condensed strips in vacuo.

11. The apparatus of claim 7, further comprising means for cooling the condensed strips in vacuo.

12. The apparatus of claim 7, further comprising means for subdividing the leaves into ribs and strips prior to condensing of the strips.

13. The apparatus of claim 12 for treating leaves which contain relatively heavy ribs and lighter strips, further comprising means for separating the strips of subdivided leaves from ribs including means for establishing and maintaining at least one stream of a gaseous carrier medium which is capable of entraining the separated strips, said subdividing means being located in said stream.

14. The apparatus of claim 13, wherein said subdividing means includes at least one mobile subdividing element in said stream.

15. The apparatus of claim 14, wherein said subdividing means comprises a plurality of subdividing elements disposed in said stream and having means for relieving strips of ribs with varying degrees of precision.

16. The apparatus of claim 15, wherein said subdividing elements are rotatable about substantially vertical axes and are disposed at different levels.

17. The apparatus of claim 16, wherein each subdividing element which is arranged to relieve strips of ribs with a lower degree of precision is located above at least one subdividing element which is arranged to relieve strips of ribs with a higher degree of precision.

18. The apparatus of claim 13, wherein said separating means comprises means for circulating the at least one stream of gaseous carrier medium along an endless path.

19. The apparatus of claim 18, further comprising means for conditioning the circulating stream.

20. The apparatus of claim 12, further comprising means for heating the leaves to a temperature of 60°–80° C. prior to subdivision of the leaves.

21. The apparatus of claim 12, further comprising means for heating the leaves to a temperature of 50°–100° C. prior to subdivision of the leaves.

22. The apparatus of claim 21, wherein said means for heating the leaves comprises means for subjecting the leaves to the action of microwaves.

23. The apparatus of claim 21, wherein said means for heating the leaves comprises means for subjecting the leaves to the action of an electric high-frequency field.

24. The apparatus of claim 21, wherein said means for heating the leaves includes means for conveying the leaves in the form of a flow and means for subjecting the leaves of the flow to the action of microwaves.

25. The apparatus of claim 21, wherein said means for heating the leaves includes means for conveying the leaves in the form of a flow and means for subjecting the leaves of the flow to the action of an electric high-frequency field.

26. The apparatus of claim 12, further comprising means for separating the ribs and strips of the subdivided leaves and means for treating the separated ribs in vacuo.

27. The apparatus of claim 26, further comprising means for heating the separated ribs prior to treatment in vacuo.

28. The apparatus of claim 27, wherein the means for heating the separated ribs comprises means for heating the ribs to a temperature of 70°–90° C.

29. The apparatus of claim 27, wherein the means for heating the separated ribs comprises means for heating the ribs to a temperature of 50°–100° C.

30. The apparatus of claim 27, wherein the means for heating the separated ribs comprises means for subjecting the ribs to the action of microwaves.

31. The apparatus of claim 27, wherein the means for heating the separated ribs comprises means for subjecting the ribs to the action of an electric high-frequency field.

32. A method of treating uncured tobacco leaves which contain ribs and strips, comprising the steps of delivering at least the strips of the leaves to a condensing station; converting the strips into a succession of bales including condensing the strips; maintaining the strips above room temperature in the course of said converting step; and drying the condensed strips in vacuo.

33. A method of treating uncured tobacco leaves which contain ribs and strips, comprising the steps of delivering at least the strips of the leaves to a condensing station; converting the strips into a succession of bales including condensing the strips; maintaining the strips above room temperature in the course of said converting step; and cooling the condensed strips in vacuo.

34. A method of treating uncured tobacco leaves which contain ribs and strips and have a moisture content of 12–18%, comprising the steps of subdividing the leaves into ribs and strips; delivering at least the strips of the leaves to a condensing station; converting the strips into a succession of bales including condensing the strips; separating the strips from ribs prior to said condensing step; and maintaining the strips above room temperature in the course of said converting step.

35. The method of claim 34 of treating uncured tobacco leaves which contain relatively heavy ribs and lighter strips, wherein said separating step comprises subdividing the leaves in at least one stream of a gaseous carrier medium which is capable of entraining the strips but not the ribs.

36. The method of claim 35, wherein said subdividing step is carried out in a plurality of successive stages in said at least one stream of gaseous carrier medium.

37. The method of claim 22, wherein said separating step further comprises circulating the at least one stream of gaseous carrier medium along an endless path.

38. The method of claim 37, further comprising the step of conditioning the at least one stream of gaseous carrier medium.

39. The method of claim 38, wherein said conditioning step includes heating the carrier medium.

40. The method of claim 38, wherein said conditioning step includes increasing the moisture content of the carrier medium.

41. The method of claim 34, further comprising the step of heating the leaves to a temperature of 60°–80° C. prior to said subdividing step.

42. The method of claim 34, further comprising the step of heating the leaves to a temperature of 50°–100° C. prior to said subdividing step.

43. The method of claim 42, wherein said heating step comprises subjecting the leaves to the action of microwaves.

44. The method of claim 42, wherein said heating step comprises subjecting the leaves to the action of an electric high-frequency field.

45. The method of claim 42, wherein said heating step comprises advancing the leaves in the form of a substantially uniform flow and subjecting the flow to the action of microwaves.

46. The method of claim 42, wherein said heating step comprises advancing the leaves in the form of a substantially uniform flow and subjecting the leaves of the flow to the action of an electric high-frequency field.

47. The method of claim 34, further comprising the steps of heating the separated ribs and drying the heated ribs in vacuo.

48. The method of claim 34, further comprising the steps of heating the separated ribs and cooling the heated ribs in vacuo.

49. The method of claim 48, wherein the step of heating the separated ribs comprises heating the ribs to a temperature of 70°–90° C.

50. The method of claim 48, wherein the step of heating the separated ribs comprises heating the ribs to a temperature of 50°–100° C.

51. The method of claim 50, wherein said heating step includes subjecting the ribs to the action of microwaves.

52. The method of claim 50, wherein said heating step includes subjecting the ribs to the action of an electric high-frequency field.

* * * * *